US007228989B2

(12) United States Patent
Bhatti et al.

(10) Patent No.: US 7,228,989 B2
(45) Date of Patent: Jun. 12, 2007

(54) HIGH EFFICIENCY BEVERAGE VENDING MACHINE

(75) Inventors: Mohinder Singh Bhatti, Amherst, NY (US); Mingyu Wang, Amherst, NY (US); David P. Rusch, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 237 days.

(21) Appl. No.: 11/104,897

(22) Filed: Apr. 13, 2005

(65) Prior Publication Data

US 2006/0231565 A1 Oct. 19, 2006

(51) Int. Cl.
*F25D 25/04* (2006.01)
*G07F 9/10* (2006.01)
*G07F 11/14* (2006.01)

(52) U.S. Cl. ..... 221/150 R; 221/92; 221/93; 221/94; 221/95; 62/440; 62/441; 312/236

(58) Field of Classification Search ..... 221/150 R, 221/150 HC, 150 A; 312/236
See application file for complete search history.

(56) References Cited

U.S. PATENT DOCUMENTS 2,048,711 A 7/1936 Ridge
2,444,593 A 7/1948 Davis
2,667,757 A 2/1954 Shoemaker
2,672,018 A 3/1954 Jacobs
2,791,099 A 5/1957 Jordan
3,866,795 A * 2/1975 Urano ..... 221/150 HC
4,021,213 A 5/1977 Neidhardt et al.
4,180,297 A * 12/1979 Abrams ..... 312/406
4,369,632 A 1/1983 Abraham
4,417,450 A 11/1983 Morgan, Jr.
4,439,998 A 4/1984 Horvay et al.
4,448,346 A 5/1984 Kuwaki et al.
4,485,633 A 12/1984 King et al.
4,510,767 A 4/1985 Komatsu et al.
4,741,178 A 5/1988 Fujiu et al.
4,773,472 A 9/1988 Aoki et al.
4,831,841 A 5/1989 Falk
5,058,393 A 10/1991 Callon et al.
5,205,129 A 4/1993 Wright et al.
5,485,953 A 1/1996 Bassett et al.
5,524,443 A 6/1996 Frank (Continued)

FOREIGN PATENT DOCUMENTS

GB 2066441 A 7/1981

(Continued)

*Primary Examiner*—Gene O. Crawford
*Assistant Examiner*—Michael K. Collins
(74) *Attorney, Agent, or Firm*—Patrick M. Griffin

(57) ABSTRACT

The invention provides a vending machine for cooling food products. The vending machine includes a housing defining an interior. The vending machine also includes a plurality of holding members substantially thermally isolated from one another and disposed in the interior. Each of the plurality of holding members includes inner and outer hollow members telescopically engaged with one another to define an inner cavity with an opening operable to communicate an individual food product and an outer cavity with an inlet and an outlet spaced from the inlet. The vending machine also includes a refrigeration system disposed outside of the interior and fluidly communicating individually with each of the outer cavities to cool each of the inner cavities.

20 Claims, 7 Drawing Sheets

U.S. PATENT DOCUMENTS

| | | | | |
|---|---|---|---|---|
| 5,671,604 | A * | 9/1997 | Rudick | 62/52.1 |
| 5,871,120 | A * | 2/1999 | Romero et al. | 222/53 |
| 6,223,817 | B1 | 5/2001 | Oden et al. | |
| 6,378,324 | B1 * | 4/2002 | Percy et al. | 62/448 |
| 6,389,822 | B1 | 5/2002 | Schanin | |
| 6,427,772 | B1 | 8/2002 | Oden et al. | |
| 6,684,657 | B1 * | 2/2004 | Dougherty | 62/237 |
| 6,739,475 | B2 * | 5/2004 | San Martin et al. | 221/150 R |
| 6,801,836 | B2 | 10/2004 | Schanin | |
| 7,001,626 | B2 * | 2/2006 | Sands et al. | 426/231 |
| 2005/0115981 | A1 * | 6/2005 | Sands et al. | 221/150 R |
| 2005/0178129 | A1 | 8/2005 | Rudick et al. | |

FOREIGN PATENT DOCUMENTS

| | | |
|---|---|---|
| GB | 2202037 A | 9/1988 |

* cited by examiner

HIGH EFFICIENCY BEVERAGE VENDING MACHINE

FIELD OF THE INVENTION

The invention relates to a vending machine and more particularly to a vending machine for cooling food products such as beverages.

BACKGROUND OF THE INVENTION

Vending machines include an interior which houses food products and is cooled by a refrigeration system. The food products are disposed in the interior to be commonly cooled. A heat exchanger is disposed in the interior and one or more fans blow air across the heat exchanger to cool the air in the interior. The cooled air then cools the food products concurrently. In a basic design of a beverage machine, the machine is divided into two chambers—the lower chamber to house the refrigeration system, generally a vapor compression system, and the upper chamber to house the stack of beverage cans or bottles. The beverage cans and bottles are loaded vertically or horizontally and then dispensed by gravity into the dispensing chute. The entire upper chamber is cooled in these machines.

Vending machines generally are made in three sizes—small, medium and large. Typically the beverage can capacity of the small machines is 100 to 300 cans, of the medium 300 to 800 cans and of the large 800 to 1,500 cans. The steady state power consumption to maintain the machines at the beverage dispensing temperature in the range 36° F. to 38° F. is 325 W for small, 800 W for the medium and 1,200 W for the large machines. The steady state energy consumption is a component of the cost associated with operating the vending machine.

SUMMARY OF THE INVENTION AND ADVANTAGES

The invention provides a vending machine for cooling food products. The vending machine includes a housing defining an interior. The vending machine also includes a plurality of holding members substantially thermally isolated from one another and disposed in the interior. Each of the plurality of holding members includes inner and outer hollow members telescopically engaged with one another to define an inner cavity with an opening operable to communicate an individual food product and an outer cavity with an inlet and an outlet spaced from the inlet. The vending machine also includes a refrigeration system disposed outside of the interior and fluidly communicating individually with each of the outer cavities to cool each of the inner cavities.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 3:
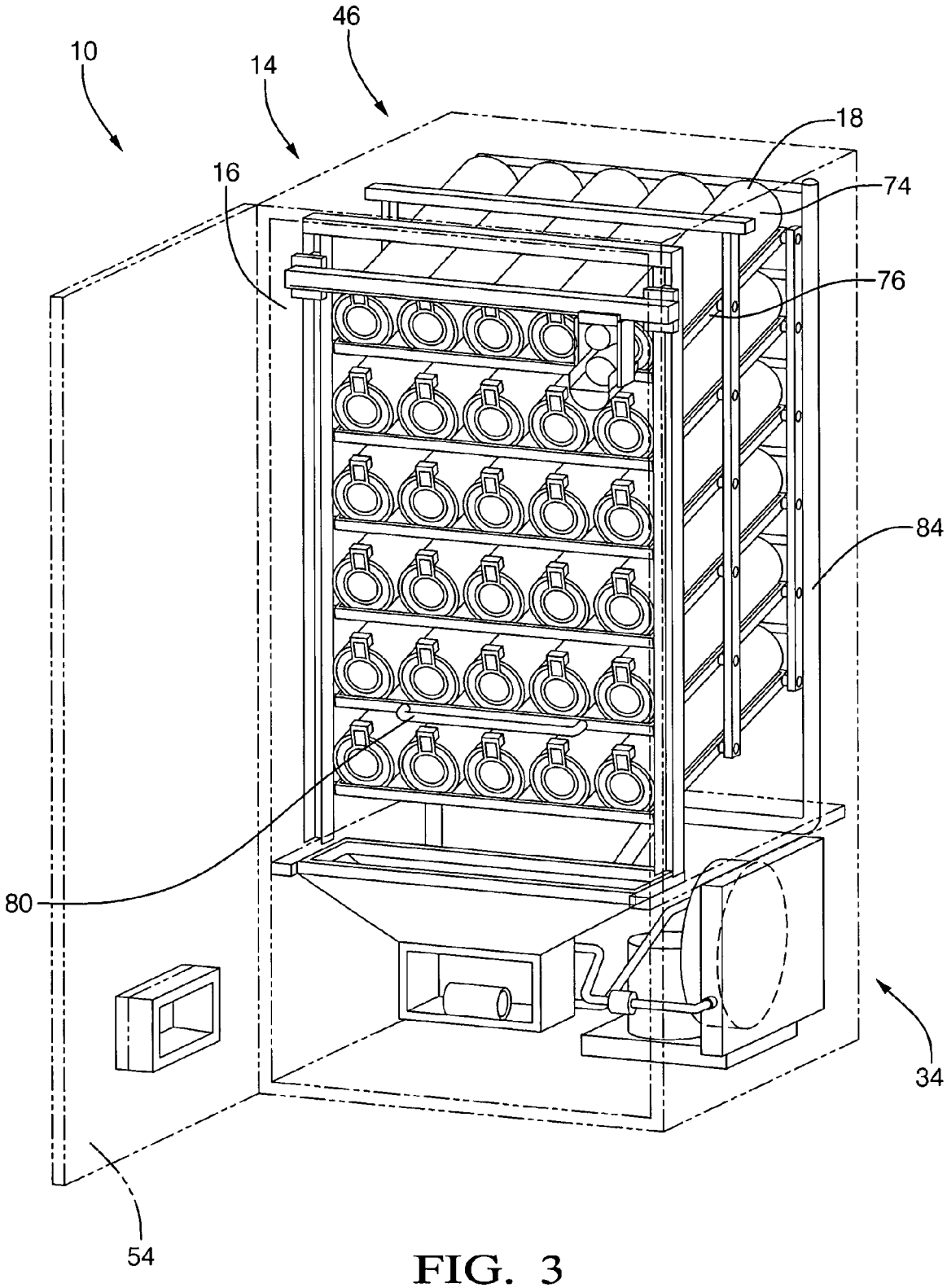
FIG. 3 is a perspective view of a vending machine according to the exemplary embodiment of the invention wherein a support frame is disposed in a food product dispensing position.

Referring to FIG. 3, a vending machine 10 for cooling food products 12 includes a housing 14 defining an interior 16. The vending machine 10 also includes a plurality of holding members 18 substantially thermally isolated from one another and disposed in the interior 16. Each of the plurality of holding members 18 includes inner and outer hollow members 20, 22 (best shown in FIG. 1) telescopically engaged with one another to define an inner cavity 24 with an opening 26 operable to communicate an individual food product 12 and an outer cavity 28 with an inlet 30 and an outlet 32 spaced from the inlet 30. The vending machine 10 also includes a refrigeration system 34 disposed outside of the interior 16 and fluidly communicating individually with each of the outer cavities 28 to cool each of the inner cavities 24.

Referring now to FIG. 3, the vending machine 10 includes an access door 54 to open the housing 14 and expose the interior 16. The vending machine 10 can be used to cool any kind of food product, liquid or solid. The exemplary vending machine 10 cools and dispenses canned or bottled beverages.

Figure 1:
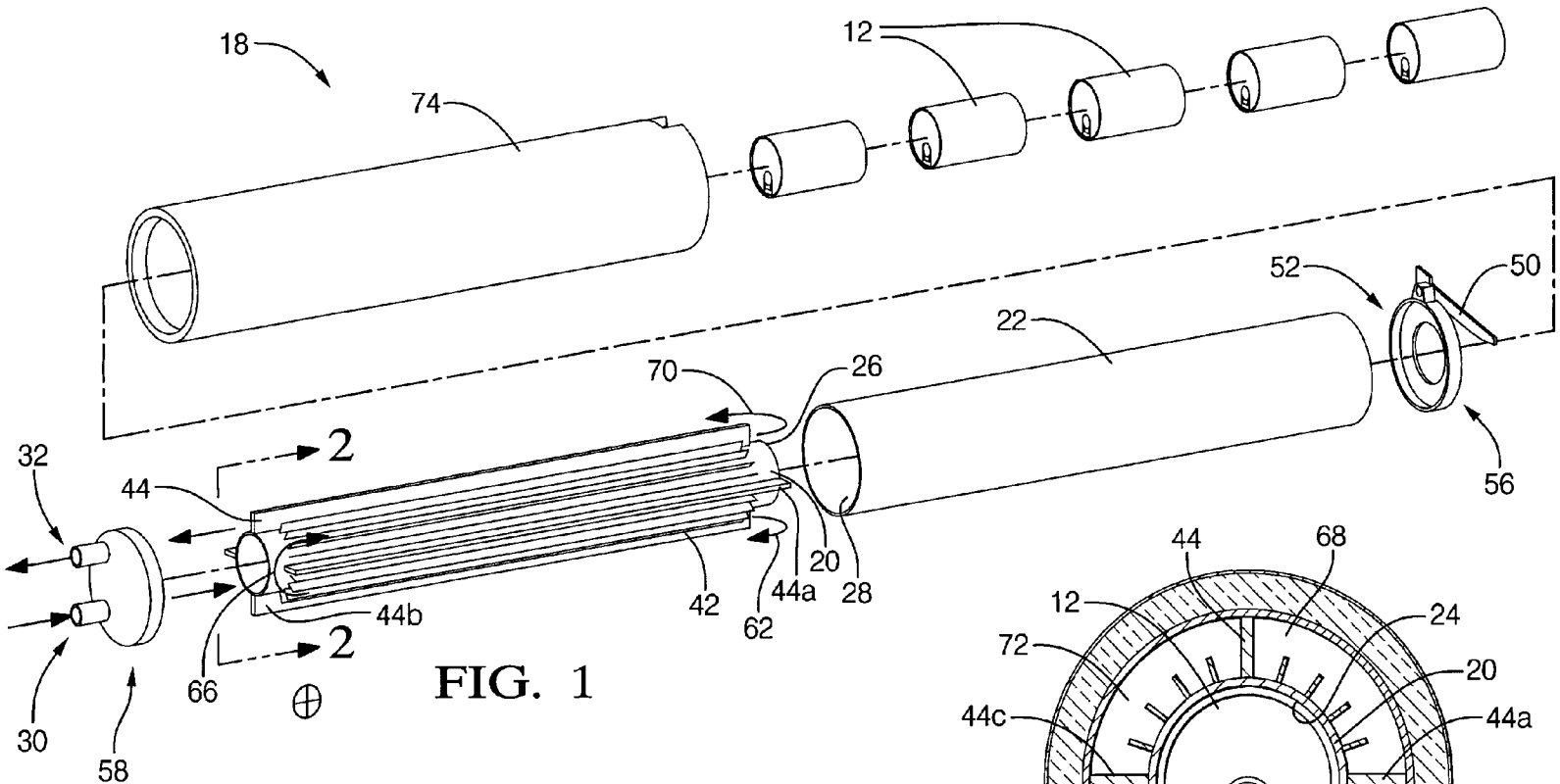
FIG. 1 is an exploded view of a food product holding member according to the exemplary embodiment of the invention.
Figure 2:
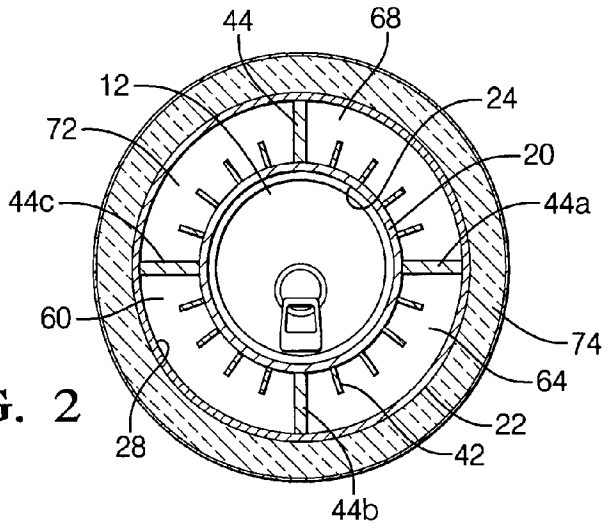
FIG. 2 is a cross-sectional view taken along section lines 2-2 in FIG. 1.

Each of the holding members 18 is structured similarly and operates similarly. Referring to FIG. 1, each holding member 18 can support a plurality of food products 12. In the exemplary embodiment of the invention, the food products 12 are beverage cans. The food products slide into the inner cavity 24 through a first end cap 56 adjacent the opening 26 until contacting a second end cap 58. The inner hollow member 20 is shaped in the exemplary embodiment to correspond to a shape of the individual food product 12. A cross-sectional area of the inner cavity 24 is minimized to closely surround an exterior of the individual food product 12. As result, the volume to be cooled is minimized. After the last food product 12 has been moved to the inner cavity 24, a door 50 that is engaged with the holding member 18 moves from an open position to a closed position to close the inner cavity 24. A spring 52 biases the door 50 to the closed position.

The inner hollow member 20 and inner cavity and food product are cooled by directing cooling fluid from the refrigeration system 34 through the outer cavity 28. Cooling fluid enters the outer cavity at the inlet 30. A plurality of guide members 44, 44*a*, 44*b*, 44*c* extend in the outer cavity 28 from the inner hollow member 20 to the outer hollow member 22. The guide members 44, 44*a*, 44*b*, are the same length, shorter than the inner and outer hollow members 20, 22, and the guide member 44*c* is as long as the inner and outer hollow members 20, 22. The guide members 44, 44*b* are axially offset from the guide member 44*a* wherein the guide members 44, 44*b* are disposed closer to the inlet 32 than the guide member 44*a* and the guide member 44*a* is disposed closer to the opening 26 than the guide members 44, 44*b*. Based on this arrangement, the fluid path defined in the outer cavity 28 is contorted. Fluid enters a portion 60 of the outer cavity 28 between the guide members 44*b* and 44*c* and travels the length of the outer cavity 28 to the end of guide member 44*b*. The fluid turns in the direction arrow 62, moving through an opening defined between the end of the guide member 44*b* and the end cap 56, to a portion 64 of the outer cavity 28 between the guide members 44*b* and 44*a*. Fluid travels the length of the portion 64 and turns in the direction arrow 66, moving through an opening defined between the end of the guide member 44*a* and the end cap 58, to a portion 68 of the outer cavity 28 between the guide members 44*a* and 44. Fluid travels the length of the portion 68 and turns in the direction arrow 70, moving through an opening defined between the end of the guide member 44 and the end cap 56, to a portion 72 of the outer cavity 28 between the guide members 44 and 44*c*. Fluid travels the length of the portion 72 and exits the outer cavity 28 through the outlet 32.

During movement through the contorted path of the outer cavity, the cooling fluid absorbs thermal energy from the food product 12 and the inner cavity 24 through the inner hollow member 20. The exemplary embodiment of the invention includes a plurality of fins 42 extending in the outer cavity 28 from the inner hollow member 20 towards the outer hollow member 22 to enhance heat transfer between the cooling fluid and the food product 12 and the inner cavity 24. An insulating sleeve 74 encircles and insulates the holding member 18 to further enhance the efficiency of heat transfer.

As shown in FIG. 1, the inlet 30 is disposed axially adjacent to the outlet 32. The inlet 30 is axially spaced from the opening 26. The inlet 30 and the outlet 32 are disposed at an opposite end of the holding member 18 from the opening 26. In alternative embodiments of the invention, the relative positions of the inlet 30, outlet 32 and opening 26 could be changed to enhance heat transfer. For example, the inlet 30 could be disposed adjacent to the opening 26 so that the food product 12 closest to the opening 26, the food product 12 to be dispensed next, is the coldest. Also, the contorted path defined in the outer cavity could be reconfigured to define a helical path. In one example, the inlet 30 could be disposed adjacent the opening 26 and follow a helical path extending away from the opening 26 toward the end cap 58. In such an embodiment, the food products 12 closest to the opening would be the coldest.

The refrigeration system 34 communicates with each outer cavity individually. In other words, the refrigeration system 34 can communicate fluid to any single outer cavity 28 or to any combination of outer cavities 28. As demonstrated by the exemplary embodiment, the invention can advantageously direct cooling fluid only to those cavities where heat transfer is required, enhancing the efficiency of the vending machine 10. For example, if a first food product 12 in first holding member 18 empties more rapidly and is filled more frequently than a second food product 12 in a second holding member 18, the second product 12 is less likely to warm when the door 54 is opened to fill the first holding member 18.

Figure 7:
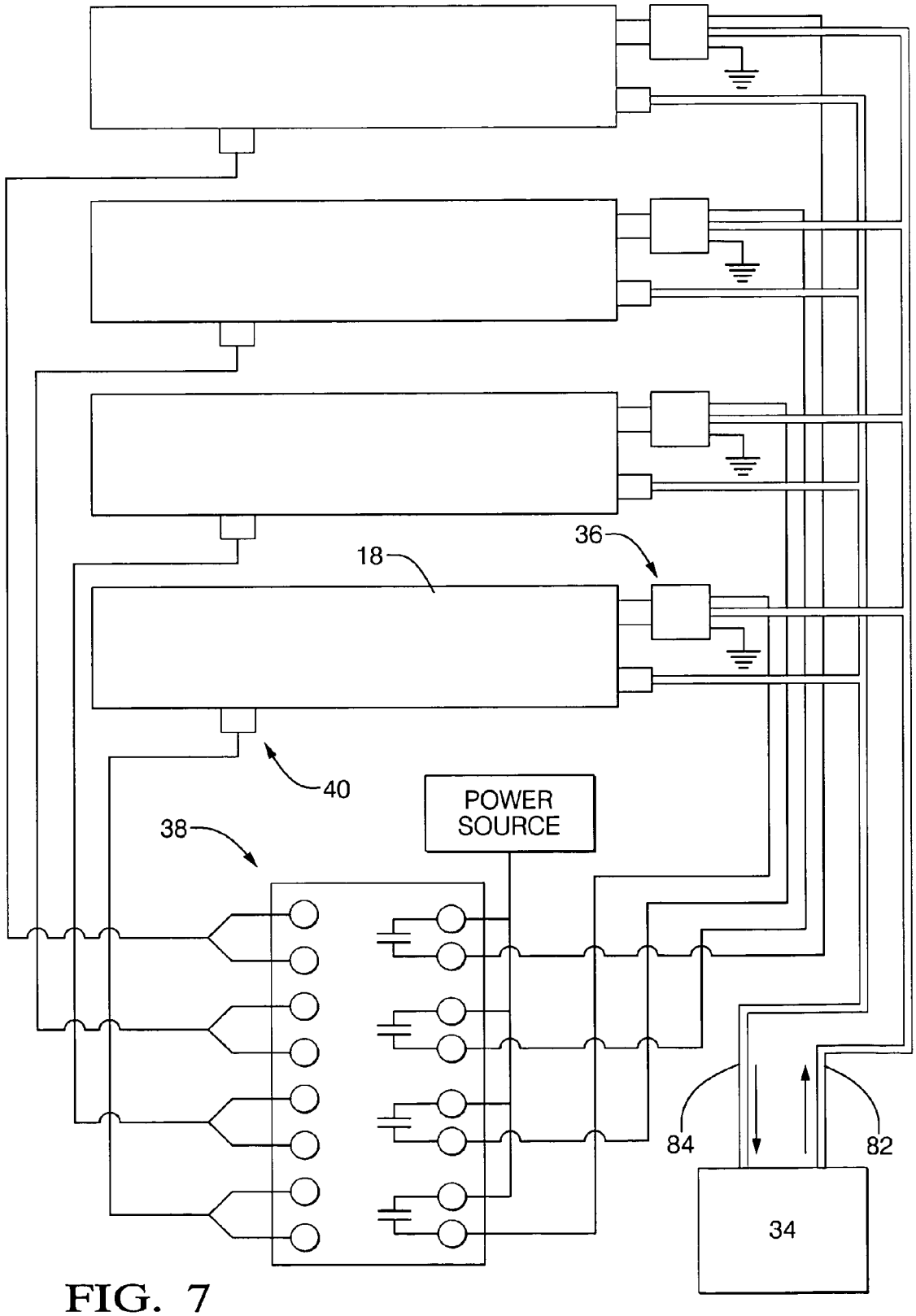
FIG. 7 is a simplified electrical schematic view of a controller, valves and sensors associated with exemplary vending machine.

Referring to FIG. 7, a valve 36 is individually fluidly disposed between the refrigeration system 34 and each of the inlets 30 to control fluid movement through the outer cavity 28. A controller 38 communicates with each valve 36 to selectively open and close. The controller 38 also controls the refrigeration system 34 to engage and move cooling fluid for heat transfer in one or more of the holding members 18. A temperature sensor 40 is disposed to sense a temperature of each of the inner cavities 24. As shown in FIG. 7, each sensor 40 communicates a signal corresponding to the sensed temperature to the controller 38. Each of the plurality of outer cavities 28 are fluidly disposed in parallel with one another. In other words, fluid does not move through one outer cavity 28 to reach an adjacent outer cavity 28. The refrigeration system 34 communicates with each of the outer cavities 28 to cool each of the inner cavities 24 to a common temperature. However, in alternative embodiments of the invention, different outer cavities 28 could be cooled to different temperatures.

The vending machine 10 also includes a support frame 46 having a plurality of pivoting shelves 76 wherein each shelf 76 is operable to receive at least one of the plurality of holding members 18. Each of the shelves 76 of the exemplary embodiment of the invention hold a plurality of holding members 18. The shelves 76 are disposed in parallel and pivot concurrently. The shelf 76 pivots about a pivot axis 78 between a dispensing position shown in FIGS. 3 and 4 and a loading position shown in FIGS. 5 and 6. The shelf 76 is substantially horizontal while in the loading position to facilitate moving of food products 12 to the inner cavity 24. The shelf 76 is acutely angled from horizontal while in the dispensing position to utilize gravity when a food product 12 is moved from the inner cavity 24. The vending machine 10 includes a locking structure having a locking handle 80 to lock the shelves 76 in at least one of the loading and dispensing positions.

Figure 4:
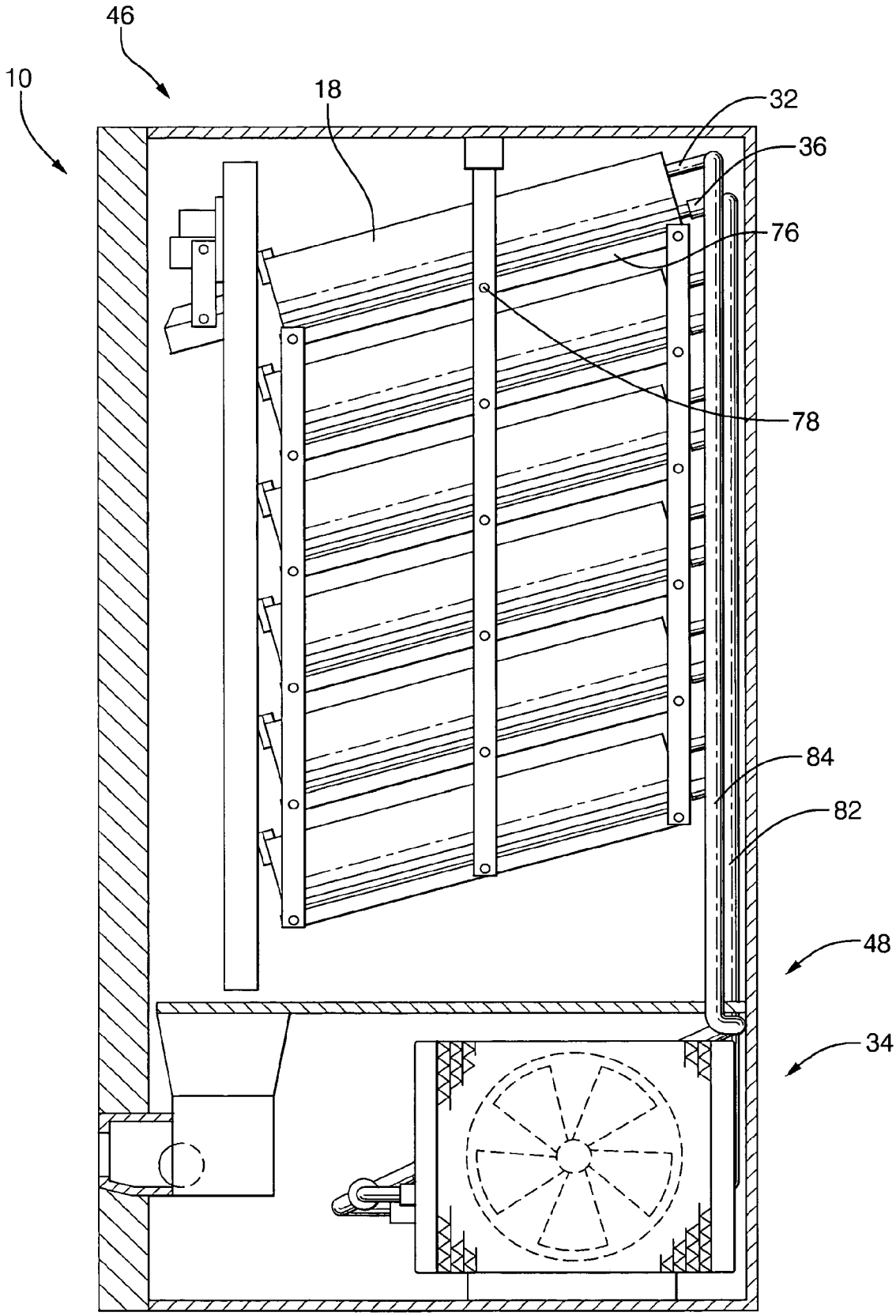
FIG. 4 is a right-hand view corresponding to the perspective view of FIG. 3.
Figure 5:
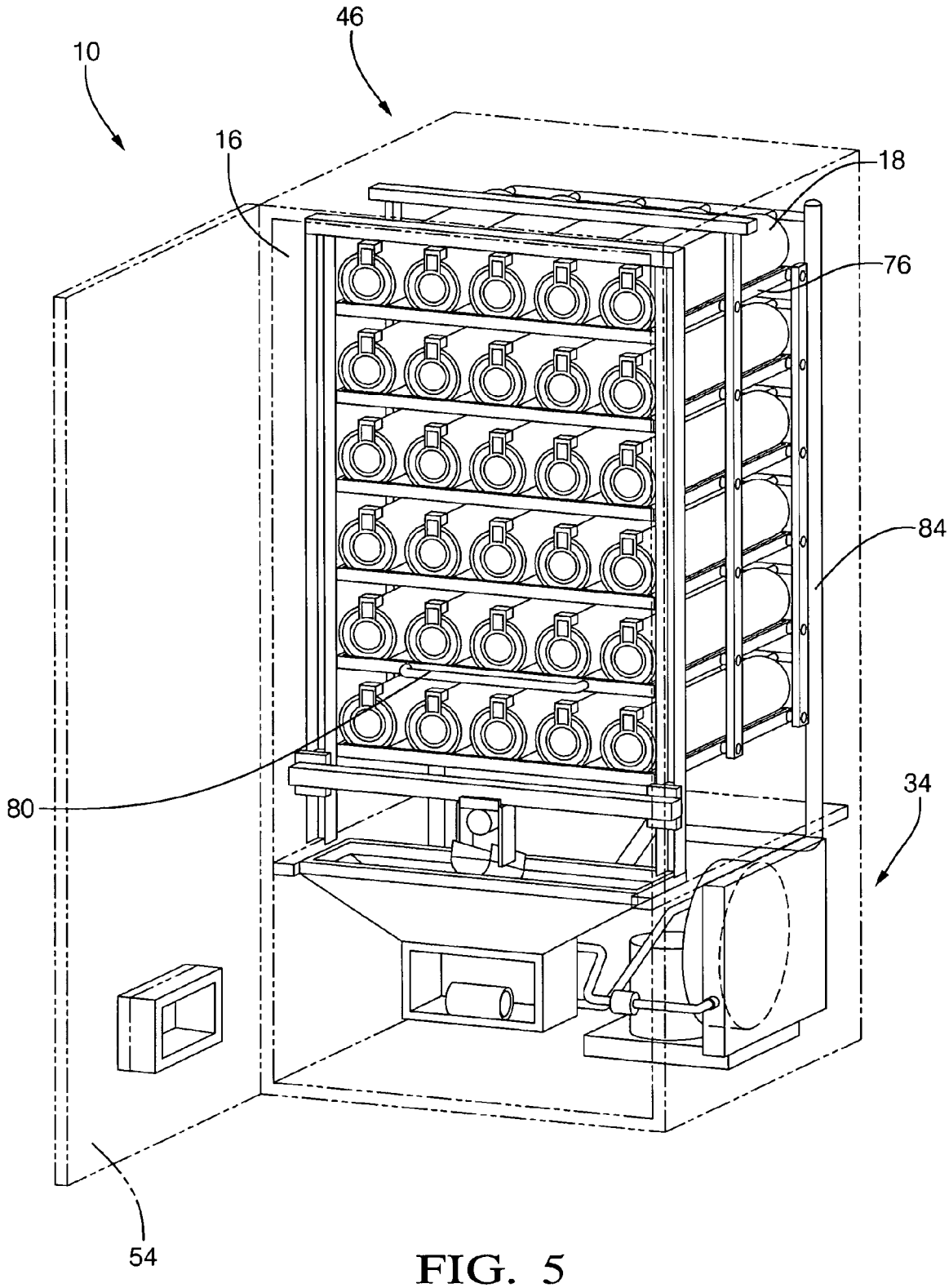
FIG. 5 is a perspective view of a vending machine according to the exemplary embodiment of the invention wherein the support frame is disposed in a food product loading position.
Figure 6:
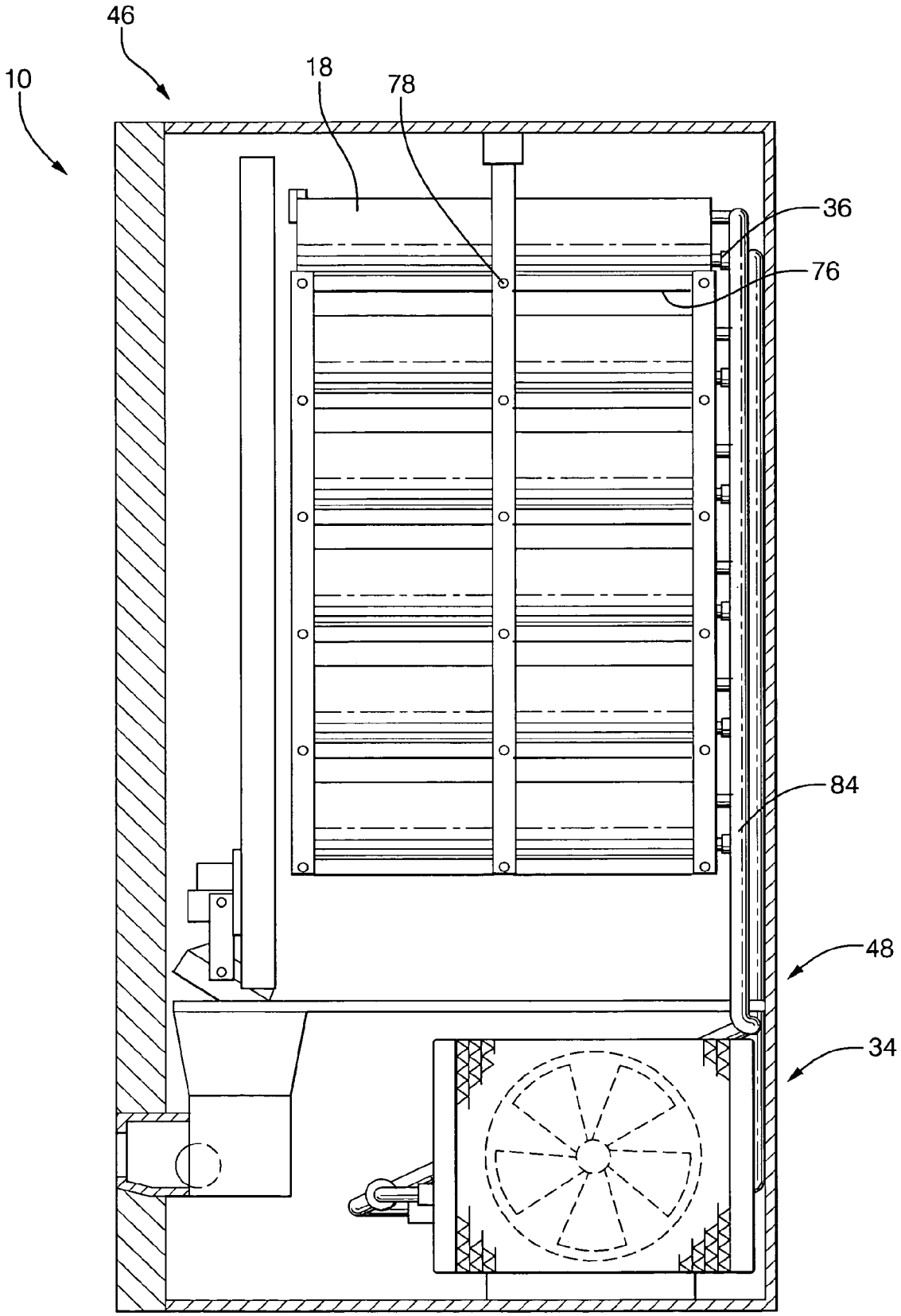
FIG. 6 is a right-hand view corresponding to the perspective view of FIG. 5.
Figure 8:
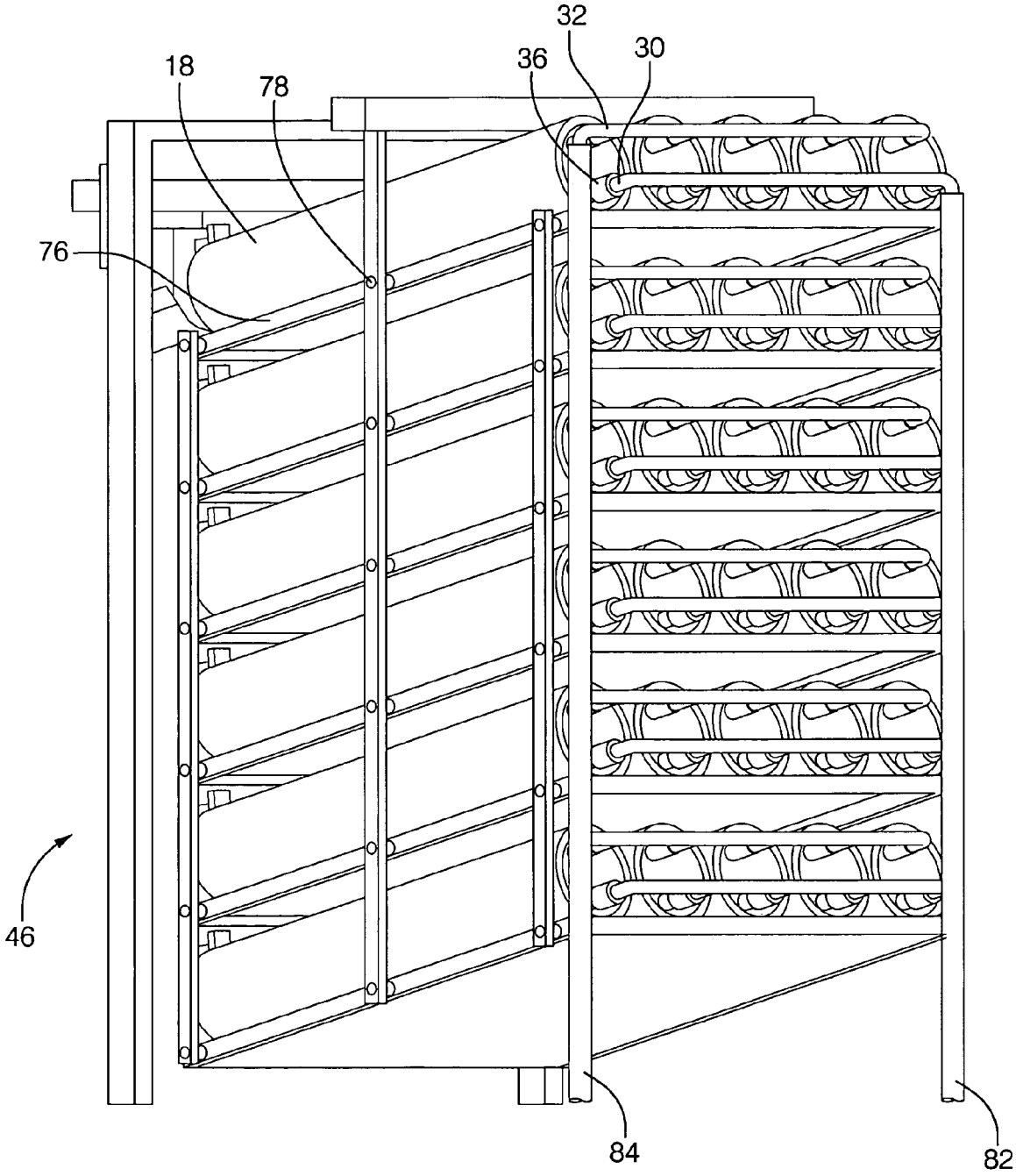
FIG. 8 is a perspective view of the support frame disposed in a food product dispensing position and a plurality of holding members.

As shown best in FIGS. 4, 6 and 8, a first primary fluid conduit 82 extends from the refrigeration system, with individual sub-lines branching off to each inlet 30. A second primary fluid conduit 84 communicates fluid back to the refrigeration system 34, receiving fluid from individual sub-lines branching into the second primary fluid conduit 84 from each outlet 32.

A flexible fluid connection 48 is disposed between the plurality of holding members 18 and the refrigeration system 34. The connection 48 accommodates relative movement between the holding members 18 and the refrigeration system 34 when the shelves 76 move between the dispensing position and the loading position.

In the present invention an entirely new design of the beverage vending machine is presented. Its features include placement of an array of cans or bottles in an insulated tubular cooler, placement of an array of tubular coolers in the upper chamber of the vending machines, a mechanism to load and dispense individual cans or bottles into or out of the tubular coolers, a dispensing mechanism to deliver the can or bottle to the dispensing chute and a control mechanism to cool only those tubular coolers, which need cooling. In the present invention machine only the tubular coolers are cooled rather than the entire upper chamber. The temperature outside the tubular coolers within the chamber could be 50° F. or higher whereas the temperature inside the cooler is at the desired level of 36° F. to 38° F. The energy efficiency of the present invention machine stems at least partially from the fact that it provides cooling of the individual cans housed in the insulated tubular coolers and only when needed. This enables downsizing the refrigeration system and reducing the operating cost of the vending machine.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A vending machine for cooling food products comprising:

a housing defining an interior;

a plurality of holding members substantially thermally isolated from one another and disposed in said interior wherein each of said plurality of holding members includes inner and outer hollow members telescopically engaged with one another to define an inner cavity with an opening operable to communicate an individual food product and an outer cavity with an inlet and an outlet spaced from said inlet; and a refrigeration system disposed outside of said interior and fluidly communicating individually with each of said outer cavities to cool each of said inner cavities.

2. The vending machine of claim 1 further comprising:

a plurality of valves wherein each of said plurality of valves is individually fluidly disposed between said refrigeration system and one of said inlets; and a controller communicating with said plurality of valves and said refrigeration system to selectively open at least one of said plurality of valves and selectively engage said refrigeration system to direct cooling fluid to at least one of said outer cavities.

3. The vending machine of claim 2 further comprising:

a plurality of temperature sensors wherein each of said plurality of temperature sensors is individually disposed to sense a temperature of one of said plurality of inner cavities and communicate a signal corresponding to the sensed temperature to said controller.

4. The vending machine of claim 3 wherein each of said plurality of outer cavities are further defined as being fluidly disposed in parallel with one another.

5. The vending machine of claim 3 wherein said refrigeration system is further defined as fluidly communicating individually with each of said outer cavities to cool each of the inner cavities to a common temperature.

6. The vending machine of claim 3 wherein said inlet is further defined as being disposed axially adjacent to said outlet.

7. The vending machine of claim 6 wherein said inlet is further defined as being axially spaced from said opening.

8. The vending machine of claim 3 wherein said inlet and said outlet are further defined as being disposed at an opposite end of said holding member from said opening.

9. The vending machine of claim 1 wherein each of said plurality of holding members further comprises:

a plurality of fins extending in said outer cavity from said inner hollow member towards said outer hollow member.

10. The vending machine of claim 1 wherein each of said plurality of holding members further comprises:

a plurality of guide members extending in said outer cavity from said inner hollow member to said outer hollow member wherein at least two of said plurality of guide members are axially offset from one another to define contorted fluid path between said inlet and said outlet.

11. The vending machine of claim 1 further comprising:

a support frame having a plurality of pivoting shelves wherein each shelf is operable to receive at least one of said plurality of holding members.

12. The vending machine of claim 11 further comprising:

a flexible fluid connection disposed between said plurality of holding members and said refrigeration system.

13. The vending machine of claim 1 further comprising:

a plurality of doors wherein each door is individually engaged with one of said plurality of holding members to move between a closed position closing said respective opening and an open position spaced from said closed position.

14. The vending machine of claim 13 further comprising:

a plurality of springs wherein each spring is individually disposed to bias one of said doors to said respective closed position.

15. A method for cooling food products with a vending machine comprising the steps of:

defining an interior with a housing;

disposing a plurality of holding members in the interior substantially thermally isolated from one another wherein each of the plurality of holding members includes inner and outer hollow members telescopically engaged with one another to define an inner cavity with an opening operable to communicate an individual food product and an outer cavity with an inlet and an outlet spaced from the inlet; and disposing outside of the interior a refrigeration system fluidly communicating individually with each of the outer cavities to cool each of the inner cavities.

16. The method of claim 15 further comprising the step of:

shaping at least the inner hollow member to correspond to a shape of the individual food product.

17. The method of claim 16 wherein said shaping step is further defined as minimizing a cross-sectional area of said inner cavity to closely surround an exterior of the individual food product.

18. The method of claim 15 further comprising the step of:

cooling each of the plurality of inner cavities to a common temperature with the refrigeration system.

19. The method of claim 15 further comprising the step of:

disposing the inlet spaced from the opening along an axis of the holding member.

20. The method of claim 15 further comprising the step of:

disposing a temperature sensor with respect to each of the plurality of holding members to sense a temperature of the inner cavity.

* * * * *